US006457933B1

(12) United States Patent
Przytulski et al.

(10) Patent No.: US 6,457,933 B1
(45) Date of Patent: Oct. 1, 2002

(54) METHODS AND APPARATUS FOR CONTROLLING BEARING LOADS WITHIN BEARING ASSEMBLIES

(75) Inventors: James Charles Przytulski, Fairfield; James Elbert Willey, West Chester; Frederic Gardner Haaser, Cincinnati; Fernando Ceccopieri, Loveland; Steven Keith Handelsman, Cincinnati, all of OH (US)

(73) Assignee: General Electric Company, Schenectady, NY (US)

( * ) Notice: Subject to any disclaimer, the term of this patent is extended or adjusted under 35 U.S.C. 154(b) by 103 days.

(21) Appl. No.: 09/748,040

(22) Filed: Dec. 22, 2000

(51) Int. Cl.[7] ..... F01D 3/00

(52) U.S. Cl. ..... 415/1; 415/104; 415/174.1

(58) Field of Search ..... 415/1, 104, 105, 415/107, 170.1, 174.1, 229; 251/326, 327, 328, 329, 193, 89, 95, 111, 112

(56) References Cited

U.S. PATENT DOCUMENTS

| | | | | |
|---|---|---|---|---|
| 2,810,394 A | | 10/1957 | Ferguson | |
| 3,452,542 A | * | 7/1969 | Saferstein et al. | 415/105 |
| 4,150,693 A | | 4/1979 | Genevey et al. | |
| 4,156,342 A | | 5/1979 | Korta et al. | |
| 4,214,436 A | | 7/1980 | Romeyke et al. | |
| 4,306,834 A | | 12/1981 | Lee | |
| 4,309,144 A | | 1/1982 | Eggmann et al. | |
| 4,483,370 A | | 11/1984 | Talasz | |
| 4,516,606 A | | 5/1985 | Worley | |
| 4,578,018 A | | 3/1986 | Pope | |
| 4,653,267 A | | 3/1987 | Brodell et al. | |
| 4,697,981 A | | 10/1987 | Brown et al. | |
| 4,730,971 A | | 3/1988 | Lin | |
| 4,730,977 A | * | 3/1988 | Haaser | 415/104 |
| 4,864,810 A | | 9/1989 | Hines | |
| 4,884,942 A | | 12/1989 | Pennink | |
| 4,907,943 A | | 3/1990 | Kelch | |
| 5,102,295 A | | 4/1992 | Pope | |
| 5,141,389 A | | 8/1992 | Bear et al. | |
| 5,154,048 A | | 10/1992 | Ponziani et al. | |
| 5,167,484 A | | 12/1992 | Ponziani et al. | |
| 5,227,062 A | | 7/1993 | Olsen | |
| 5,312,225 A | | 5/1994 | Lorenzen | |
| 5,312,226 A | | 5/1994 | Miura et al. | |
| 5,318,273 A | | 6/1994 | Geist et al. | |
| 5,358,378 A | | 10/1994 | Holscher | |
| 5,376,827 A | | 12/1994 | Hines | |
| 5,735,666 A | | 4/1998 | Johnston | |
| 5,760,289 A | | 6/1998 | Skottegard | |
| 5,791,868 A | | 8/1998 | Bosley et al. | |
| 5,827,040 A | | 10/1998 | Bosley et al. | |
| 5,975,141 A | | 11/1999 | Higazy | |
| 6,036,433 A | | 3/2000 | Skinner | |
| 6,067,791 A | | 5/2000 | Patel | |

FOREIGN PATENT DOCUMENTS

| | | |
|---|---|---|
| JP | 9-4248 | 2/1997 |
| JP | 9-280388 | 10/1997 |

* cited by examiner

*Primary Examiner*—Edward K. Look
*Assistant Examiner*—Igor Kershteyn
(74) *Attorney, Agent, or Firm*—William Scott Andes

(57) ABSTRACT

An orifice plate assembly for a gas turbine engine that facilitates extending a useful life of bearing assemblies within the gas turbine engine is described. Each orifice plate assembly is coupled in flow communication with an engine air source, and includes a first body portion and a second body portion. The first body portion includes a channel and a flow opening. The channel is sized to receive the second body portion, such that the second body portion may slide with respect to the first body portion. The orifice plate assembly is adjustable after engine shutdown to regulate bearing loading.

20 Claims, 3 Drawing Sheets

METHODS AND APPARATUS FOR CONTROLLING BEARING LOADS WITHIN BEARING ASSEMBLIES

BACKGROUND OF THE INVENTION

This invention relates generally to gas turbine engines and, more particularly, to methods and apparatus for regulating bearing loads within gas turbine engine bearing assemblies.

Gas turbine engines include a high pressure compressor, a combustor, and a high pressure turbine. The high pressure compressor includes a rotor, and a plurality of stages. The rotor is supported with a plurality of bearing assemblies that include an inner race, an outer race, and a plurality of rolling elements between the inner and outer races. Maintaining bearing loads within pre-defined limits during engine operation facilitates extending a useful life of the bearing assembly.

To regulate the bearing load, at least some known gas turbine engines use compressor bleed air. The bleed air is routed through delivery lines including orifice plate assemblies. The orifice plate assemblies are multi-piece assemblies and each orifice plate assembly includes a discretely sized opening that limits an amount of airflow through the orifice plate assembly and thus regulates a pressure/flow from the air sources.

During engine operation, when engine parameters indicate that bearing load is exceeding pre-defined limits, engine operation is stopped and the orifice plate assembly is replaced with a different orifice plate assembly that has a different sized opening. Because each orifice plate assembly is discretely sized, a large inventory of plates is often maintained. Because of the complexity of the multi-piece orifice plate assemblies, replacing the orifice plate assemblies is often a time-consuming and costly process.

BRIEF SUMMARY OF THE INVENTION

In an exemplary embodiment, an orifice plate assembly for a gas turbine engine facilitates extending a useful life of bearing assemblies within the gas turbine engine. Each orifice plate assembly is coupled within the engine in flow communication with an engine air source, and each includes a first body portion and a second body portion. The first body portion includes a channel and a flow opening. The channel is sized to receive the second body portion, such that the second body portion may slide with respect to the first body portion. More specifically, the second body portion may be positioned to cover any portion or all of the first body portion flow opening.

During engine operation, when parameters measured indicate that bearing loads are approaching pre-defined limits, the orifice plate assembly may be adjusted after engine shutdown to regulate air pressure and flow to facilitate maintaining bearing loads within the limits. More specifically, to adjust the orifice plate assembly, the second body portion is loosened from the first body portion and is repositioned with respect to the first body portion. As the second body portion is repositioned, a cross-sectional flow area through the first body portion flow opening is changed. When bearing loads are reestablished within the pre-defined limits, the second body portion is re-secured to the first body portion. As a result, the orifice plate assembly facilitates extending a useful life of a bearing assembly in a highly reliable and cost-effective manner.

DETAILED DESCRIPTION OF THE INVENTION

Figure 1:
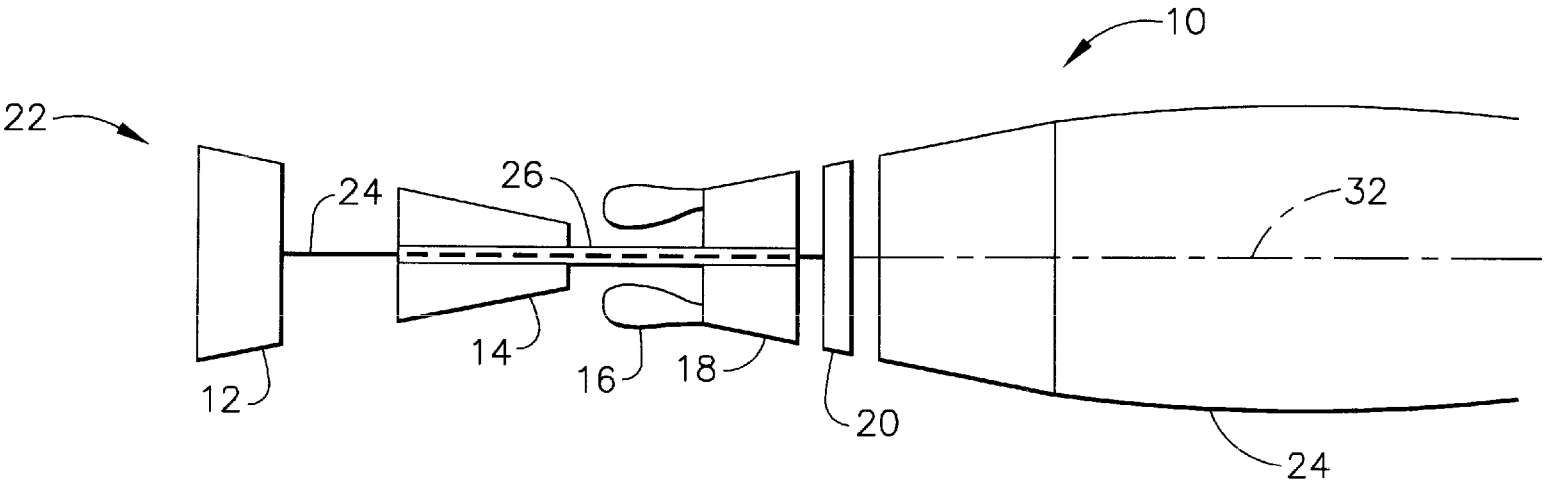
FIG. 1 is a schematic illustration of a gas turbine engine.

FIG. 1 is a schematic illustration of a gas turbine engine 10 including at least one compressor 12, a combustor 16, a high pressure turbine 18, a low pressure turbine 20, an inlet 22, and an exhaust nozzle 24 connected serially. In one embodiment, engine 10 is an LM2500+ engine commercially available from General Electric Company, Cincinnati, Ohio. Compressor 12 and turbine 18 are coupled by a first shaft 26. Engine 10 also includes a centerline axis of symmetry 32.

In operation, air flows into engine inlet 22 through compressor 12 and is compressed. The compressed air is then delivered to combustor 16 where it is mixed with fuel and ignited. Airflow from combustor 16 drives rotating turbines 18 and 20 and exits gas turbine engine 10 through exhaust nozzle 24.

Figure 2:
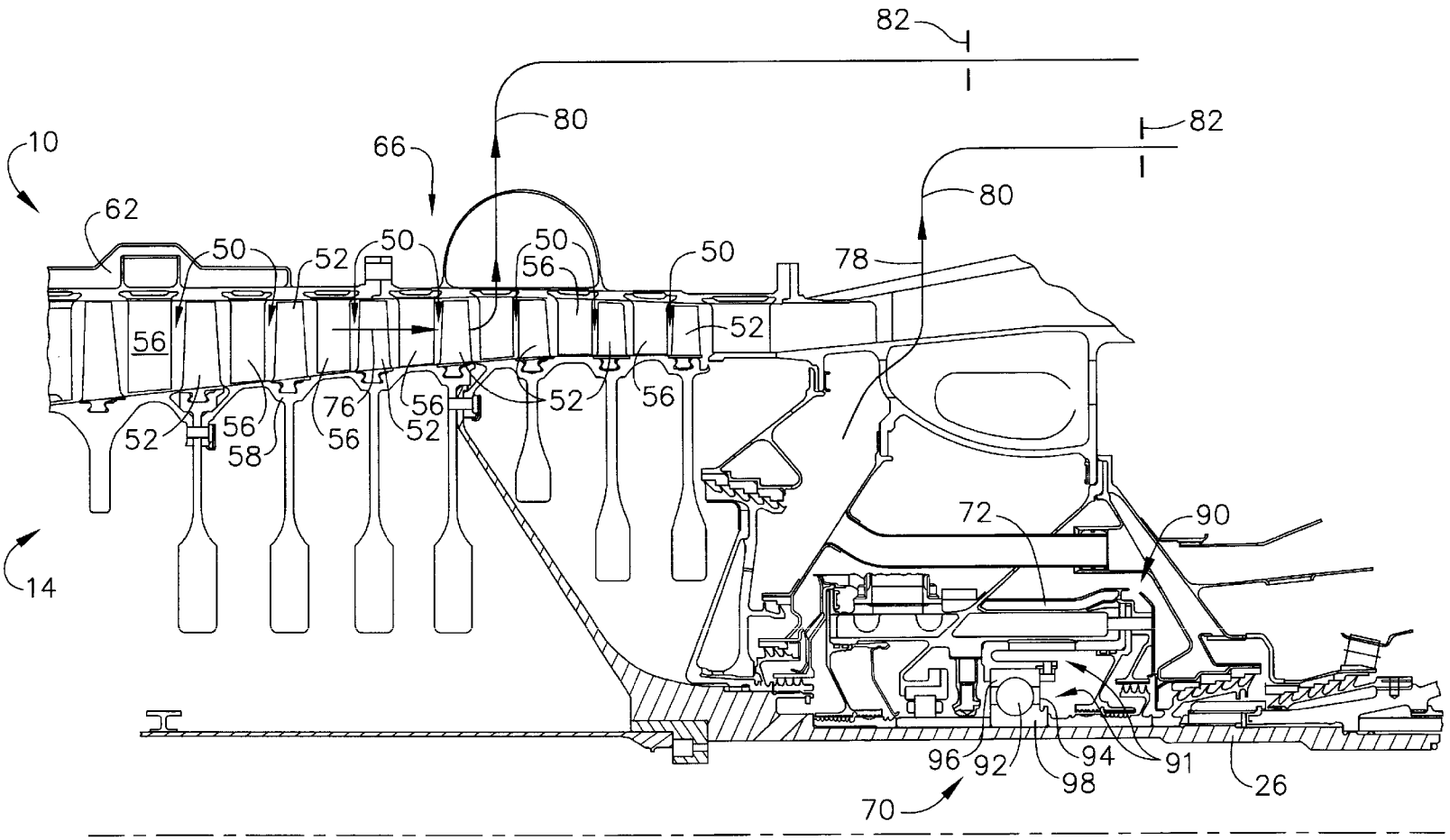
FIG. 2 is a cross-sectional view of a portion of the gas turbine engine shown in FIG. 1.

FIG. 2 is a cross-sectional view of a portion of gas turbine engine 10. Compressor 14 includes a plurality of stages 50, and each stage 50 includes a row of rotor blades 52 and a row of stator vanes 56. Rotor blades 52 are circumferentially spaced apart, and are typically supported by rotor spools and disks 58 connected to rotor shaft 26. Rotor blades 52 and stator vanes 56 are coaxial with respect to engine centerline axis 32. A row of circumferentially spaced apart stator vanes 56 extend between each row of adjacent rotor blades 52 and are supported with an annular outer engine casing 62.

Compressor bleed air is extracted from high pressure compressor 14 from intermediate stages 66 of compressor 14 and used to regulate bearing loads of bearing assemblies 70 coupled to an engine frame 72. In one embodiment, bearing loads of a #4B thrust bearing assembly are regulated using high pressure compressor recoup compressor air 78. In another embodiment, bearing loads of a #7B thrust bearing assembly are regulated using stage 13 high pressure compressor bleed 76.

More specifically, a plurality of air delivery lines 80 are coupled in flow communication to various stages of compressor 14, and are used for supplying fluid flow for controlling bearing loads of bearing assemblies 70 and #7B bearing assemblies. Each air delivery line 80 includes an orifice plate assembly 82. Orifice plate assembly 82, described in more detail below, is adjustable and may be adjusted after engine shutdown to regulate pressure/flow through delivery lines 80 from compressor 14.

In an exemplary embodiment, bearing assembly 70 is enclosed within a sealed annular compartment 90 radially bounded by rotor shaft 26 and support frame 72. Bearing assembly 70 includes a paired race 91, a plurality of rolling elements 92, and a cage 94. More specifically, paired race 91 includes an outer race 96 and an inner race 98 that is radially inward from outer race 96. Each rolling element 92 is between inner race 98 and outer race 96, and in rolling contact with inner and outer races 98 and 96, respectively. Furthermore, rolling elements 92 are spaced circumferentially by cage 94.

During operation, engine 10 uses high pressure compressor recoup air 78 and high pressure compressor bleed 76 supplied through delivery lines 80 to control bearing loads. More specifically, bearing loads are maintained between pre-determined limits to facilitate extending useful bearing life. Orifice plate assemblies 82 regulate the pressure/flow from compressor sources 78 and 76. More specifically, when parameters measured during engine operation indicate that bearing loads are approaching pre-determined limits, orifice plate assemblies 82 may be adjusted after engine shutdown to control bearing loads.

Figure 3:
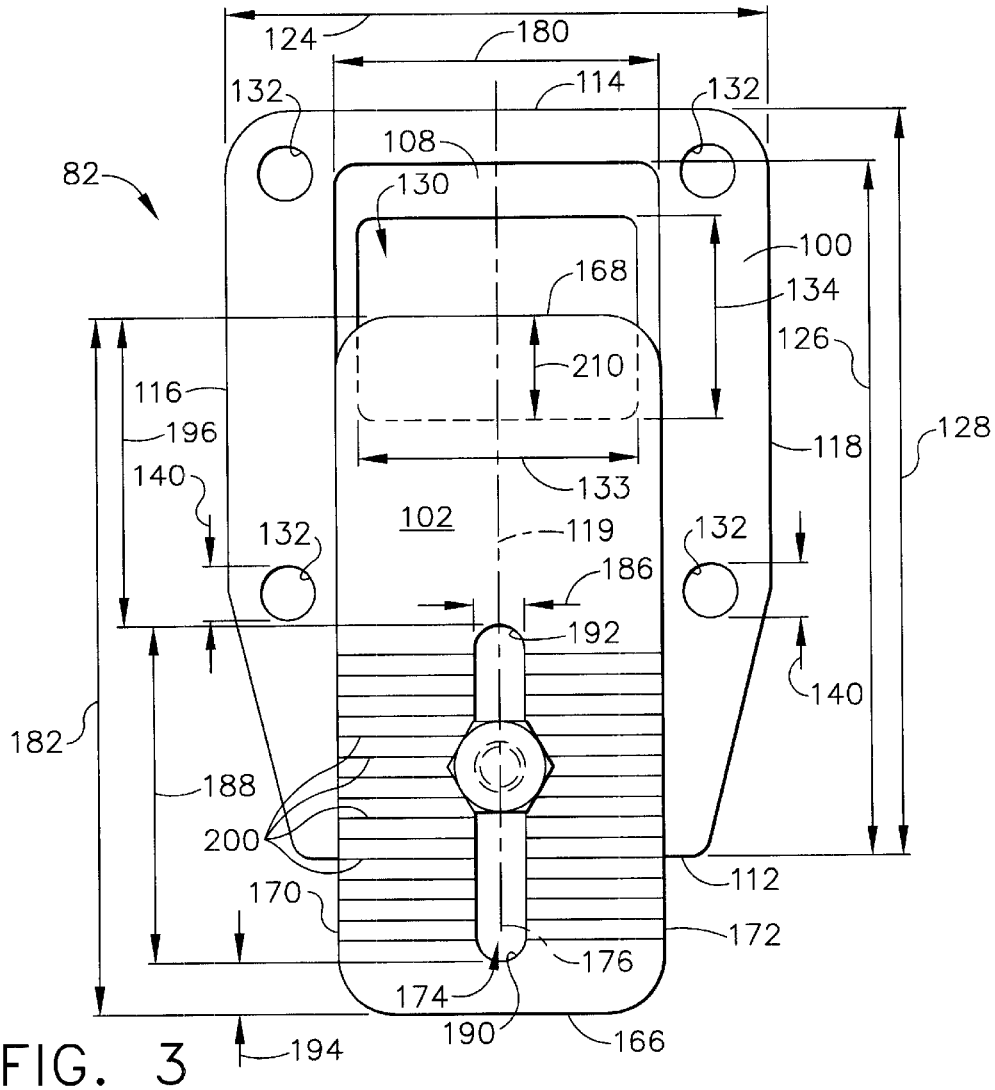
FIG. 3 is a plan view of an orifice plate assembly used with the gas turbine engine shown in FIG. 2.
Figure 4:
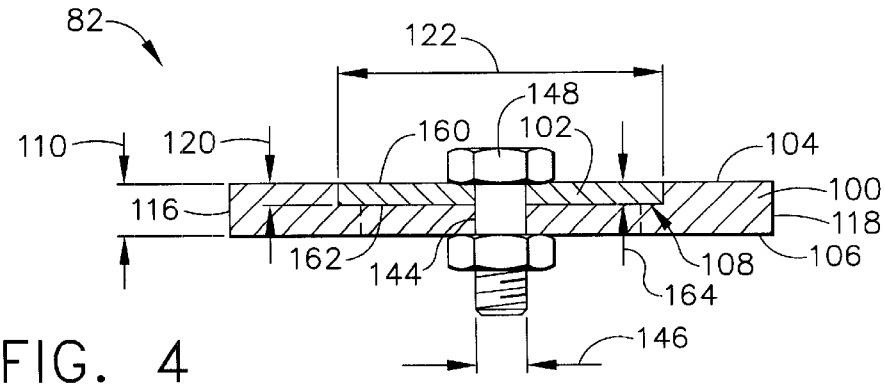
FIG. 4 is a side view of the orifice plate assembly shown in FIG. 2.

FIG. 3 is a plan view of orifice plate assembly 82 that may be used with gas turbine engine 10 (shown in FIGS. 1 and 2). FIG. 4 is a side view of orifice plate assembly 82. Orifice plate assembly 82 includes a first body portion 100 and a second body portion 102. First body portion 100 includes an upper surface 104, a lower surface 106, and a channel 108, and has a thickness 110 measured between upper and lower surfaces 104 and 106, respectively. First body portion 100 also includes an inlet side 112 and a rear side 114 connected with a pair of sidewalls 116 and 118. An axis of symmetry 119 extends from first body portion inlet side 112 to rear side 114.

First body portion channel 108 is sized to receive second body portion 102 therein. More specifically, channel 108 extends a distance 120 into first body portion 100 towards first body portion lower surface 106 from first body portion upper surface 104. Channel depth 120 is smaller than first body portion thickness 110. Additionally, channel 108 has a width 122 that is smaller than a width 124 of first body portion 100. Furthermore, channel 108 also extends inward towards first body portion rear side 114 from first body portion inlet side 112 for a length 126. Channel length 126 is smaller than a length 128 of first body portion 100 measured between inlet and rear sides 112 and 114, respectively.

First body portion 100 also includes a flow opening 130 and a plurality of attachment openings 132. Flow opening 130 extends from first body portion upper surface 104 to lower surface 106. More specifically, flow opening 130 is co-axially positioned with respect to first body portion 100 within channel 108. A width 133 of flow opening 130 is smaller than channel width 122, and a length 134 of flow opening 130 is smaller than channel length 126. In one embodiment, flow opening 130 has a substantially rectangular cross-sectional profile. In another embodiment, flow opening 130 has a non-rectangular cross sectional profile.

First body portion attachment openings 132 extend through first body portion 100 from first body portion upper surface 104 to lower surface 106. Each attachment opening 132 has a diameter 140 sized to receive a fastener (not shown) therethrough to secure each orifice plate assembly 82 to engine 10 (shown in FIGS. 1 and 2). More specifically, attachment openings 132 extend through first body portion 100 between first body portion channel 108 and sidewalls 116 and 118.

First body portion 100 also includes an alignment opening 144. Alignment opening 144 is between flow opening 130 and first body portion inlet side 112 within channel 108. Alignment opening 144 extends through first body portion 100 from first body portion upper surface 104 to lower surface 106, and has a diameter 146 sized to receive an alignment fastener 148 therethrough. Alignment fastener 148 secures orifice plate assembly second body portion 102 in position with respect to first body portion 100. In one embodiment, alignment fastener 148 is a threaded bolt and locking nut.

Orifice plate assembly second body portion 102 includes an upper surface 160 and a lower surface 162, and has a thickness 164 measured between upper and lower surfaces 160 and 162, respectively. Second body portion thickness 164 is smaller than first body portion thickness 110. In one embodiment, orifice plate assembly second body portion thickness 164 is approximately equal first body portion channel depth 120.

Orifice second body portion 102 also includes an inlet side 166 and a rear side 168 connected with a pair of sidewalls 170 and 172, and an alignment slot opening 174. Second body portion 102 also includes an axis of symmetry 176 extending from second body portion inlet side 166 to rear side 168. Second body portion axis of symmetry 176 is substantially co4inear with first body portion axis of symmetry 119.

Orifice second body portion 102 has a width 180 measured between sidewalls 170 and 172 that is smaller than orifice first body portion width 124. Second body portion width 180 is slightly smaller than first body portion channel width 122, such that second body portion 102 is received in slidable contact within first body portion channel 108. In one embodiment, orifice second body portion length 182 is approximately equal first body portion channel length 126. Accordingly, first body portion channel 108 is sized to receive second body portion 102, such that second body portion upper surface 160 is substantially co-planar with first body portion upper surface 104. Furthermore, first body portion channel 108 permits second body portion 102 to slide therein with respect to first body portion 100.

Orifice second body portion alignment slot opening 174 is co-axially aligned with respect to axis of symmetry 176. Alignment slot opening 174 has a width 186 that is approximately equal first body portion alignment opening diameter 146. Accordingly, orifice second body portion alignment slot opening 174 is sized to receive alignment fastener 148 therethrough. Alignment slot opening 174 has a length 188 measured between an inlet end 190 and a rear end 192.

Alignment slot inlet end 190 is a distance 194 from second body portion inlet side 166, and alignment slot rear end 192 is a distance 196 from second body portion rear side 168. Alignment slot opening length 188 is longer than first body portion flow opening length 134.

A plurality of graduation lines 200 extend from second body portion sidewall 170 to sidewall 172. More specifically, graduation lines extend from second body portion alignment slot opening 174 to each respective sidewall 170 and 172, to provide reference indications used in aligning second body portion 102 with respect to first body portion 100. In one embodiment, second body portion 102 also includes reference numbers (not shown) used in aligning second body portion 102 with respect to first body portion 100.

During assembly of orifice plate assembly 82, fasteners are inserted through first body portion attachment openings 132 to secure orifice plate assembly 82 in flow communication with a respective air delivery line 80 (shown in FIG. 2). More specifically, orifice plate assembly 82 is secured such that first body portion flow opening 130 is in flow communication with an air delivery line 80. Second body portion 102 is then coupled to first body portion 100. More specifically, second body portion 102 is inserted within first body portion channel 108 such that second body portion rear side 168 initially enters first body portion channel 108. Second body portion 102 is then slid towards first body portion rear side 114, such that second body portion upper surface 160 is substantially co-planar with first body portion upper surface 104.

After second body portion 102 has been slid into position with respect to first body portion 100 and is in a desired position, as indicated by second body portion graduation lines 200, a portion 210 of first body portion flow opening 130 may be covered by second body portion 102. Portion 210 is infinitely variable and is determined by a relative position of second body portion 102 with respect to first body portion 100. More specifically, second body portion alignment slot opening length 188 permits second body portion to be positioned such that any percentage of flow opening 130 from approximately zero percent to approximately one hundred percent may be covered with second body portion 102.

When a desired percentage of first body portion flow opening 130 is covered by second body portion 102, alignment fastener 148 is extended through first body portion alignment opening 144 and second body portion alignment slot opening 174. Alignment fastener 148 is then tightened to secure second body portion 102 in position relative to first body portion 100.

During engine operation, when parameters measured during engine operation indicate bearing loads are approaching the pre-defined limits, orifice plate assembly may be adjusted after engine shutdown to regulate the pressure/flow to maintain bearing loads within the limits to facilitate extending bearing assembly useful life. More specifically, alignment fastener 148 is loosened and orifice plate assembly second body portion 102 is repositioned with respect to first body portion 100 to ensure a cross-sectional flow area through first body portion flow opening 130 maintains an appropriate bearing load. Because second body portion 102 is slid with respect to first body portion 100, orifice adjustments are infinitely variable. In addition, because orifice plate assembly 82 is variably adjustable, orifice plate assembly 82 may be used for fine tuning bearing loads as performance parameters and bearing loads drift during a useful life of engine 10.

The above-described orifice plate assembly for a gas turbine engine is cost-effective and highly reliable. The orifice plate assembly includes a second body portion that is received within a first body portion. A position of the second body portion is infinitely variable with respect to the first body portion to regulate bearing loads. Furthermore, the orifice plate assembly may be adjusted after engine shutdown. Thus, the orifice plate assembly facilitates extending a useful life of engine bearing assemblies in a cost-effective and reliable manner.

While the invention has been described in terms of various specific embodiments, those skilled in the art will recognize that the invention can be practiced with modification within the spirit and scope of the claims.

What is claimed is:

1. A method for regulating bearing loads of a gas turbine engine bearing assembly using an orifice plate assembly, the orifice plate assembly including a first body portion and a second body portion, the first body portion including an opening extending therethrough, said method comprising the steps of:

coupling the orifice plate assembly to the gas turbine engine in flow communication with the bearing assembly;

supplying air through the orifice plate assembly first body portion opening; and coupling the orifice plate assembly second body portion to the first body portion to regulate an amount of air flowing through the orifice plate assembly first body portion opening, such that the second body portion slides with respect to the first body portion.

2. A method in accordance with claim 1 wherein the first body portion includes an upper surface, a channel, and a lower surface, the channel extending from the upper surface towards the lower surface, said step of coupling the orifice plate assembly second body portion to the first body portion further comprising the step of sliding the orifice plate assembly second body portion relative to the orifice first plate assembly body portion on the engine to change an amount of air flowing through the orifice plate first body portion opening.

3. A method in accordance with claim 1 wherein the second body portion includes an upper surface and a lower surface, the second body portion upper surface including a plurality of graduation lines, said step of coupling the orifice plate assembly second body portion to the first body portion further comprising the step of using the graduation lines to align the second body portion with respect to the first body portion.

4. A method in accordance with claim 3 wherein the second body portion includes an upper surface and a lower surface, said step of coupling the orifice plate assembly second body portion to the first body portion further comprising the step of inserting the second body portion within the first body portion, such that the second body portion upper surface is substantially co-planar with a first body portion upper surface.

5. A method in accordance with claim 1 wherein the first body portion includes an alignment opening, the second body portion includes an alignment opening, said method further comprising the step of extending a fastener through the first and second body portion alignment openings to secure the second body portion in position relative to the first body portion.

6. Apparatus for a gas turbine engine including a bearing assembly, said apparatus comprising an orifice plate sub-assembly comprising a first body portion and a second body portion, said first body portion comprising an opening extending therethrough, said second body portion configured to slide relative to said first body portion to regulate an amount of fluid flowing through said first body portion opening for controlling bearing load of said bearing assembly.

7. Apparatus in accordance with claim 6 wherein said orifice plate sub-assembly second body portion comprises an alignment opening configured to receive a fastener therethrough.

8. Apparatus in accordance with claim 6 wherein said orifice plate sub-assembly first body portion further comprises a first alignment opening, said orifice plate sub-assembly second body portion comprises a second alignment opening, said first alignment opening and said second alignment opening configured to receive a fastener therethrough for securing said second body portion to said first body portion.

9. Apparatus in accordance with claim 8 wherein said orifice plate sub-assembly second body portion second alignment opening comprises a slot.

10. Apparatus in accordance with claim 6 wherein said orifice plate sub-assembly first body portion comprises a channel sized to receive said second body portion therein.

11. Apparatus in accordance with claim 10 wherein said orifice plate sub-assembly second body portion comprises an upper surface and lower surface, said orifice plate sub-assembly first body portion comprises an upper surface and a lower surface, said first body portion channel configured to receive said second body portion, such that said second body portion upper surface substantially coplanar with said first body portion upper surface.

12. Apparatus in accordance with claim 6 wherein said orifice plate sub-assembly second body portion comprises a plurality of graduation lines configured to align said second body portion with respect to said orifice plate sub-assembly first body portion, said second body portion configured to be repositioned with respect to said first body portion while installed on the engine to regulate an amount of fluid flowing through said first body portion opening for controlling bearing load of said bearing assembly.

13. A gas turbine engine comprising:

bearing assembly; and an orifice plate assembly configured to regulate a bearing load of said bearing assembly, said orifice plate assembly comprising a first body portion and a second body portion, said first body portion comprising an opening extending therethrough, said second body portion coupled to said first body portion to regulate an amount of fluid flowing through said first body portion opening for controlling bearing loading of said bearing assembly, such that said second body portion slides relative to said first body portion.

14. A gas turbine engine in accordance with claim 13 wherein said orifice plate assembly second body portion configured to be repositioned with respect to said first body portion while attached to said engine.

15. A gas turbine engine in accordance with claim 14 wherein said orifice plate assembly first body portion comprises an upper surface, a channel, and a lower surface, said channel extending from said upper surface towards said lower surface and sized to receive said orifice plate assembly second body portion therein.

16. A gas turbine engine in accordance with claim 15 wherein said orifice plate assembly second body portion comprises an upper surface and a lower surface, said second body portion received within said orifice plate assembly first body portion such that said second body portion upper surface substantially co-planar with said first body portion upper surface.

17. A gas turbine engine in accordance with claim 15 wherein said orifice plate assembly first body portion further comprises an alignment opening configured to receive a fastener therethrough.

18. A gas turbine engine in accordance with claim 17 wherein said orifice plate assembly second body portion further comprises an alignment opening, said first and second body portion alignment openings configured to receive a fastener therethrough to secure said second body portion in position relative to said first body portion.

19. A gas turbine engine in accordance with claim 18 wherein said orifice plate assembly second body portion alignment opening comprises a slot.

20. A gas turbine engine in accordance with claim 15 wherein said orifice plate assembly second body portion comprises a plurality of graduation lines configured to align said second body portion with respect to said first body portion.

* * * * *

UNITED STATES PATENT AND TRADEMARK OFFICE

CERTIFICATE OF CORRECTION

PATENT NO. : 6,457,933 B1
DATED : October 1, 2002
INVENTOR(S) : Przytulski et al.

It is certified that error appears in the above-identified patent and that said Letters Patent is hereby corrected as shown below:

Column 5,
Lines 62-63, delete “engine in flow communication with the bearing assembly;” and insert therefore -- engine; --.

Column 6,
Lines 10-11, delete “first plate assembly body portion” and insert therefor -- plate assembly first body portion --.
Line 12, between “plate” and “first” insert -- assembly --.
Line 20, after “align the” insert -- orifice plate assembly --.
Line 20, between “to the” and “first” insert -- orifice plate assembly --.

Signed and Sealed this

Fifth Day of April, 2005

JON W. DUDAS
*Director of the United States Patent and Trademark Office*